US005562386A

United States Patent [19]

Browning

[11] Patent Number: 5,562,386

[45] Date of Patent: Oct. 8, 1996

[54] REFUSE BIN GRABBING APPARATUS

[75] Inventor: David J. Browning, Glen Iris, Australia

[73] Assignee: MacDonald Johnston Engineering Co. Pty. Ltd., Australia

[21] Appl. No.: 351,267

[22] PCT Filed: Jun. 8, 1993

[86] PCT No.: PCT/AU93/00272

§ 371 Date: Dec. 5, 1994

§ 102(e) Date: Dec. 5, 1994

[87] PCT Pub. No.: WO93/25457

PCT Pub. Date: Dec. 23, 1993

[30] Foreign Application Priority Data

Jun. 8, 1992 [AU] Australia ..... PL2926

[51] Int. Cl.[6] ..... B65F 3/04

[52] U.S. Cl. ..... 414/408; 414/406; 414/555

[58] Field of Search ..... 414/406, 408, 414/409, 555, 733, 739; 294/86.4, 99.1, 106, 902

[56] References Cited

U.S. PATENT DOCUMENTS

| | | | |
|---|---|---|---|
| 3,165,348 | 1/1965 | Keskitalo . | |
| 3,172,693 | 3/1965 | Hansen . | |
| 3,322,455 | 5/1967 | Gressbach | 294/81 |
| 3,762,586 | 10/1973 | Updike, Jr. . | |
| 3,970,342 | 7/1976 | Cotton | 294/86 R |
| 4,084,706 | 4/1978 | Russell | 214/1 D |
| 4,212,577 | 7/1980 | Swanson | 414/23 |
| 4,227,849 | 10/1980 | Worthington | 414/408 |
| 4,227,850 | 10/1980 | Farmer et al. . | |
| 4,281,956 | 8/1981 | Pickrell . | |
| 4,367,891 | 1/1983 | Wauer et al. | 294/88 |
| 4,401,407 | 8/1983 | Breckenridge . | |
| 4,435,117 | 3/1984 | House | 414/620 |
| 4,461,608 | 7/1984 | Boda . | |
| 4,669,940 | 6/1987 | Englehardt et al. | 414/409 X |
| 4,708,570 | 11/1987 | Smith et al. | 414/408 |
| 4,790,708 | 12/1988 | Bennigsen-Mackiewicz et al. | 414/403 |
| 5,020,844 | 6/1991 | Pickrell | 294/86.4 |
| 5,026,104 | 6/1991 | Pickrell | 294/86.4 |
| 5,092,731 | 3/1992 | Jones et al. | 414/406 |
| 5,209,537 | 5/1993 | Smith et al. | 294/111 |

FOREIGN PATENT DOCUMENTS

| | | | |
|---|---|---|---|
| 521074 | 11/1979 | Australia . | |
| 75458/81 | 1/1981 | Australia . | |
| 82407/82 | 10/1982 | Australia . | |
| 60231/90 | 2/1991 | Australia . | |
| 629710 | 5/1991 | Australia . | |
| 629165 | 7/1992 | Australia . | |
| 634439 | 2/1993 | Australia . | |
| 0287433 | 10/1988 | European Pat. Off. . | |
| 0327948 | 8/1989 | European Pat. Off. . | |
| 2632938 | 12/1989 | France . | |
| 2558466 | 7/1977 | Germany . | |
| 3620610 | 2/1987 | Germany | 414/408 |
| 998405 | 7/1965 | United Kingdom . | |
| 2092987 | 8/1982 | United Kingdom . | |
| 4018098 | 8/1994 | WIPO | 414/408 |

*Primary Examiner*—James W. Keenan

*Attorney, Agent, or Firm*—Burns, Doane, Swecker & Mathis, LLP

[57] ABSTRACT

There is disclosed a refuse bin grabbing apparatus for grabbing a bin for movement to an elevated unloading position for emptying into a refuse truck including a power-driven linkage 5 for moving a bin-grasping clamp 2,3 towards inter-engagement with a refuse bin, the grasping clamp including articulated clamping arms 3 for embracing a refuse bin, the arms being fitted with a flexible belt 6 located between the clamping arms and a bin to be clamped so that the belt is tensioned in the bin engaging position; the articulated clamping arms are retractable to an out-of-the-way position (FIG. 1) to ensure that the clamping arms 3 do not protrude from the outer confines of the vehicle in the rest position.

15 Claims, 6 Drawing Sheets

REFUSE BIN GRABBING APPARATUS

BACKGROUND OF THE INVENTION

1. Field of the Invention

The present invention relates to a refuse bin grabbing apparatus, particularly a so-called side lift system.

2. Description of the Prior Art

Systems of this type are described in our earlier patent application No. 60231/90 first filed 8th Aug., 1989.

A major advantage of this system is the possibility of single man operation of the motor vehicle, loading of the contents of a refuse bin and restoring the refuse bin to its original position without the operator leaving his driving position.

Other prior art known to the Applicant includes Australian Petty Patent No. 629165 disclosing hydraulically actuated grab fingers for a refuse bin. U.S. Pat. No. 3,762,586 discloses articulated arms on a front loading refuse vehicle.

U.S. Pat. No. 4,401,407 discloses a grasping arm on a refuse collection vehicle with an inner arm pivotally mounted on a frame with an outer arm pivoted between its ends to the inner arm. The outer arm is hydraulically moved graspingly in response to movement of the inner arm by a linkage mechanism. The grasping arm is adapted for grasping containers of varying shapes and sizes.

Australian Patent Application 634439 discloses gripping apparatus for a refuse bin including pivotal arm means and a flexible element for gripping a refuse bin.

Australian Patent No. 521074 discloses hydraulically actuated fixed arms pivoted at a shoulder pivot.

U.S. Pat. No. 3,172,693 discloses a barrel grab assembly suitable for a fork lift truck.

Australian lapsed Application No. 75458/81 discloses a side loader with grasping arms pivoted at a shoulder joint.

U.S. Pat. No. 4,227,850 discloses a paper roll handling clamp for lift trucks with pivoting clamp arms.

U.S. Pat. No. 4,461,608 discloses a handling apparatus for a rear-loading refuse truck with a pair of pivotal clamping arms.

Australian Application No. 82407/82 discloses pivotal grab arms for a container pick-up vehicle.

U.S. Pat. No. 4,281,956 discloses a front-loading grabber apparatus with pivoting arms.

U.S. Pat. No. 3,165,348 discloses an articulated grabbing arm mechanism with padding thereon for grasping logs, barrels and pipes, etc.

None of the prior art known to the Applicant appears to address the problem of engaging closely-spaced bins and achieving full retraction of the grabbing arms in an out-of-the-way position. Furthermore, the present invention sets out to minimise mechanical damage to the refuse bin in a clamping operation.

Problems have been encountered with known grabber systems causing damage to the bins which are usually made from plastic material; achieving quick cyclic operation in a loading and releasing operation and requiring minimum clearance between bins lined up in rows to allow entry of the grabbing apparatus during normal operation of the vehicle between loading cycles.

Optimum positioning of the grabbing apparatus relative to the vehicle chassis will assist in reduction of load/unloading cycle time for each refuse bin.

SUMMARY OF THE INVENTION

There is provided according to the present invention a remote control refuse bin grabbing apparatus for grabbing a bin for movement to an elevated unloading position, including a power driven linkage mounted for moving a bin engaging means towards inter-engagement with the bin, said bin engaging means including a retractable grabber means including clamping arm means for engaging and firmly grabbing a bin, wherein the grabber means includes a pair of articulated grabber arms adapted to move into embrace with the bin in a grabbing and lifting apparatus, the grabber arms being retractable into an out of the way rest position not protruding from the confines of the vehicle in said position. Thus the vehicle can be legally driven with the grabber arms in said out of the way rest position but well positioned to commence its next loading cycle.

There is provided according to a further aspect of the invention a refuse bin grabbing apparatus for grabbing a bin for movement to an elevated unloading position including a power driven linkage mounted for moving a bin engaging means towards inter-engagement with the bin, bin engaging means including a retractable grabber means including articulated clamping arm means for embracing a bin said arms being fitted with flexible belt means located between the clamping arms and a bin to be clamped the arrangement being such that the belt is tensioned to substantially fully engage and clamp the refuse bin when said clamping arm means are moved to embrace a refuse bin.

The arrangement is such that the flexible belt means contacts the bin over a relatively large surface area with few, if any, high pressure forces being directly applied to the bin by the articulated clamping arm means.

The grabber arms are configured and constructed to move in such a way to require minimal lateral spacing relative to the side of the bin so that closely spaced bins, or bins closely spaced to some fixed object, can be accessed and grasped for emptying.

In a specific aspect of the invention there is provided a remote control refuse bin grabbing apparatus including a pair of grabber arms having connected thereto a flexible belt means extending along the length of the grabber arms and adapted to contact and grip a refuse bin, the grabber arms including an elbow joint between the ends of the arms to allow retraction of the arms and belt means to an out-of-the-way position.

Conveniently the belt means is supported by securement to the grabber arms at each end thereof and preferably at an intermediate point along the length of the grabber arms.

In a further aspect of the invention the belt may be secured at a central stationary location on the grabbing apparatus or alternatively is formed in two separate parts and secured to pivot points forming a shoulder joint for each of the grabber arms.

It has been found that this latter construction provides a more positive support for the belt means in reducing a tendency for the belt to sag when in an untensioned position.

The grabber mechanism described is inter-changeable with different types of lifting heads, for example a vacuum operated head of the same general type as is disclosed in Australian published specification No. 65312/90 and also German specification No. 2558466, European specifications Nos. 287433 and 327948.

BRIEF DESCRIPTION OF THE DRAWINGS

The invention will be described in greater detail with reference to the accompanying drawings in which.

DESCRIPTION OF THE PREFERRED EMBODIMENTS

Figure 1:
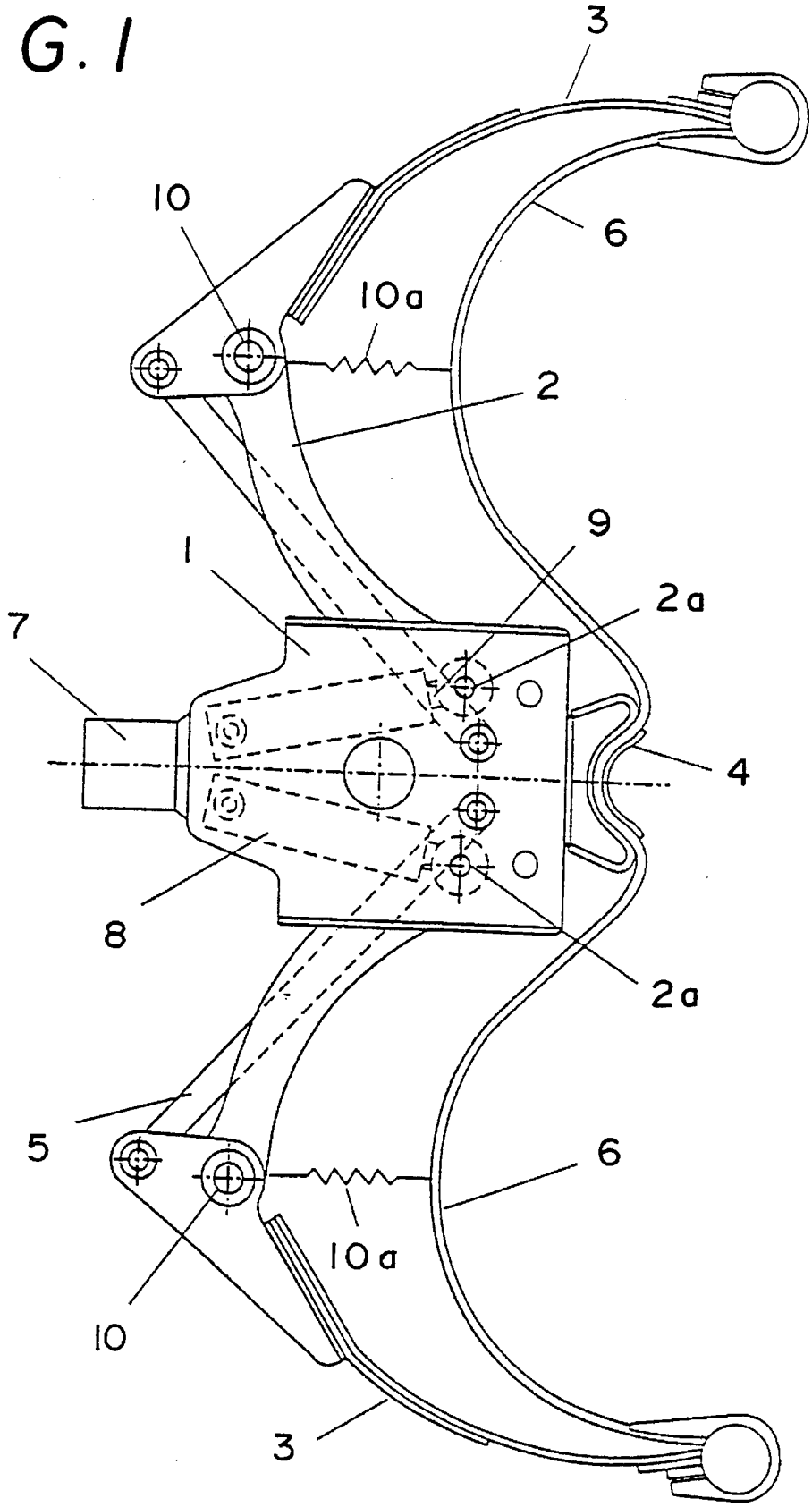
FIG. 1 shows a plan view of a grabber mechanism in a ready to load position.

With reference to the drawings, the grabber mechanism includes a pair of shoulder arm members 2 connected through an elbow joint 10 to arm members 3. The shoulder arm members 2 are controlled by a pair of power cylinders 8 mounted on the housing-ram box 1 to control pivotal movement of the shoulder arm members 2 about shoulder pivot 2*a* which in turn move the arm members 3 to a loading position. The power cylinders 8 are in turn controlled by a valve 7 and can conveniently be actuated by remote control by the driver of the refuse vehicle to which the equipment is attached.

The links 5 are adapted to control the pivotal movement of the shoulder arm members 2 to promote a linear movement of the arm members 3 to reduce to a minimum the lateral movement of the arm members about elbow pivot point 10. In other words the projecting and retracting movement of the arm members 3 is directed outwardly of the grabber mechanism, whilst the arm movements are controlled to minimize their lateral span and hence cause the leading edges of the arms to move forward along a path which is a shallow arc lying generally linearly forward of the grabber mechanism. This feature coupled with the relatively narrow dimension of the grabber arms allows entry between narrowly spaced refuse bins, or bins position to a close to an immovable object such as a power pole or the like. It also means that the grabber apparatus does not require as much chassis space and can be located closer to the front axle of the truck for even weight distribution on the vehicle.

Figure 4:
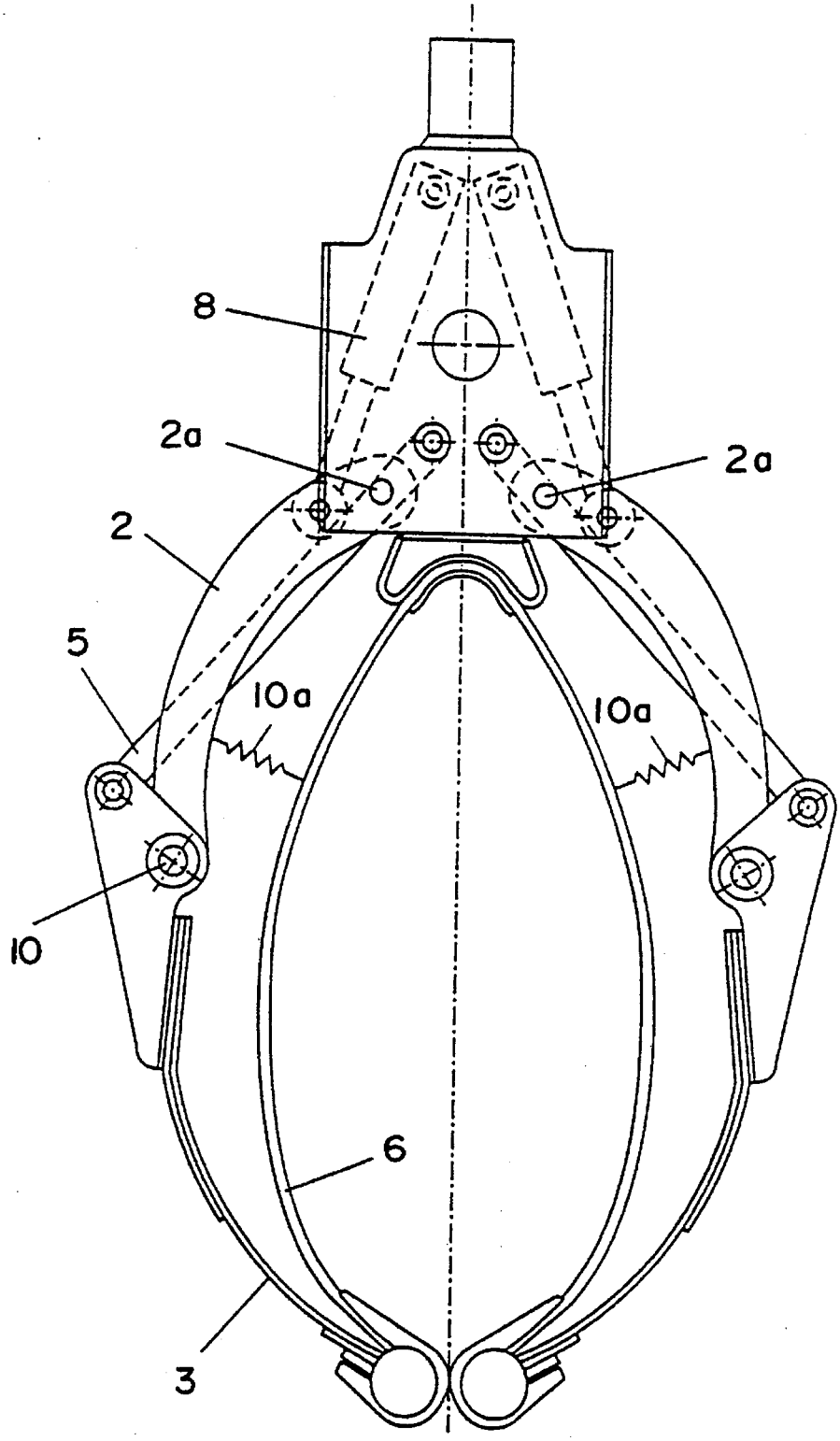
FIG. 4 is a plan view of the grabber mechanism in a fully clamped position.

The arm members 3 have mounted thereon a gripping belt 6 connected at the ends of the arms and also on a support mount 4 on the grabber mechanism to extend with the arm members to embrace a refuse bin as shown in FIG. 4 in the fully clamped position.

A small tension spring 10*a* is optionally provided, secured between the shoulder arm member 2 and the belt 6 to restrain slack movement of the belt during movement from a retracted position to a bin engaging position. The belt 6 is drawn into surface-to-surface contact with a refuse bin and contacts the bin over a relatively large surface area to reduce or avoid localised large high pressure forces being directly applied by the arm members 2 and 3 to the bin surface.

Figure 5:
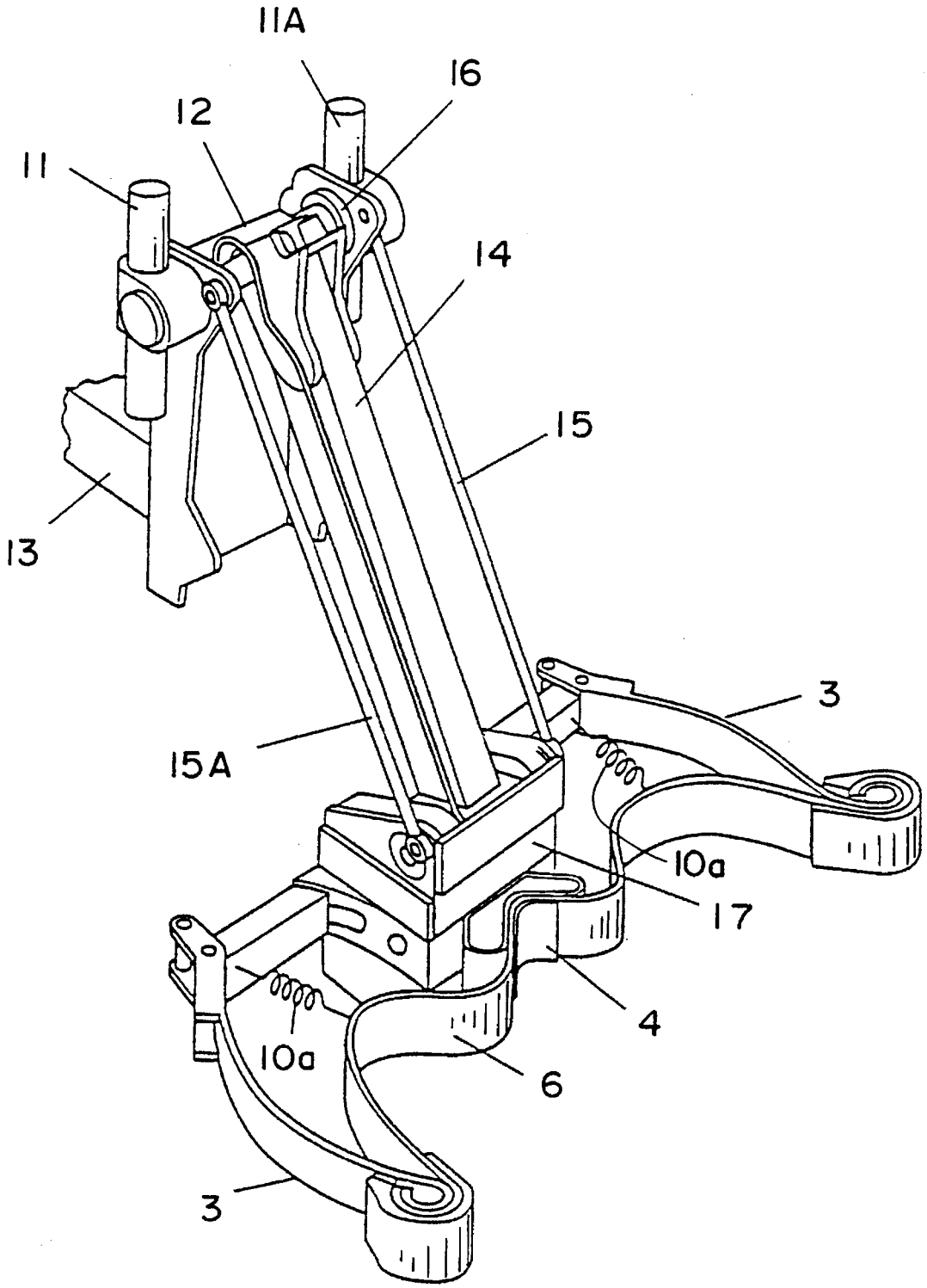
FIG. 5 is a perspective view from above showing the grabber mechanism in more detail.

The grabbing mechanism as is best shown in FIG. 5 is fully adjustable to accommodate various width bins from 80 to 300 liter square style bins and 135 to 300 liter round style bins. The grabber mechanism can be fitted to the left hand or right hand side of the truck. The flexibility of the arm member 3 in combination with the belt support allows the belt to unfold and wrap around a bin of varying configurations and varying positions and yet it is unlikely to cause any material damage to the construction of the bin whilst taking a firm grip on the bin during an unloading operation. The fully closed position illustrated in FIG. 4 represents the maximum closing movement of the grabbing mechanism and will vary according to the size of the bin being grasped.

Figure 2:
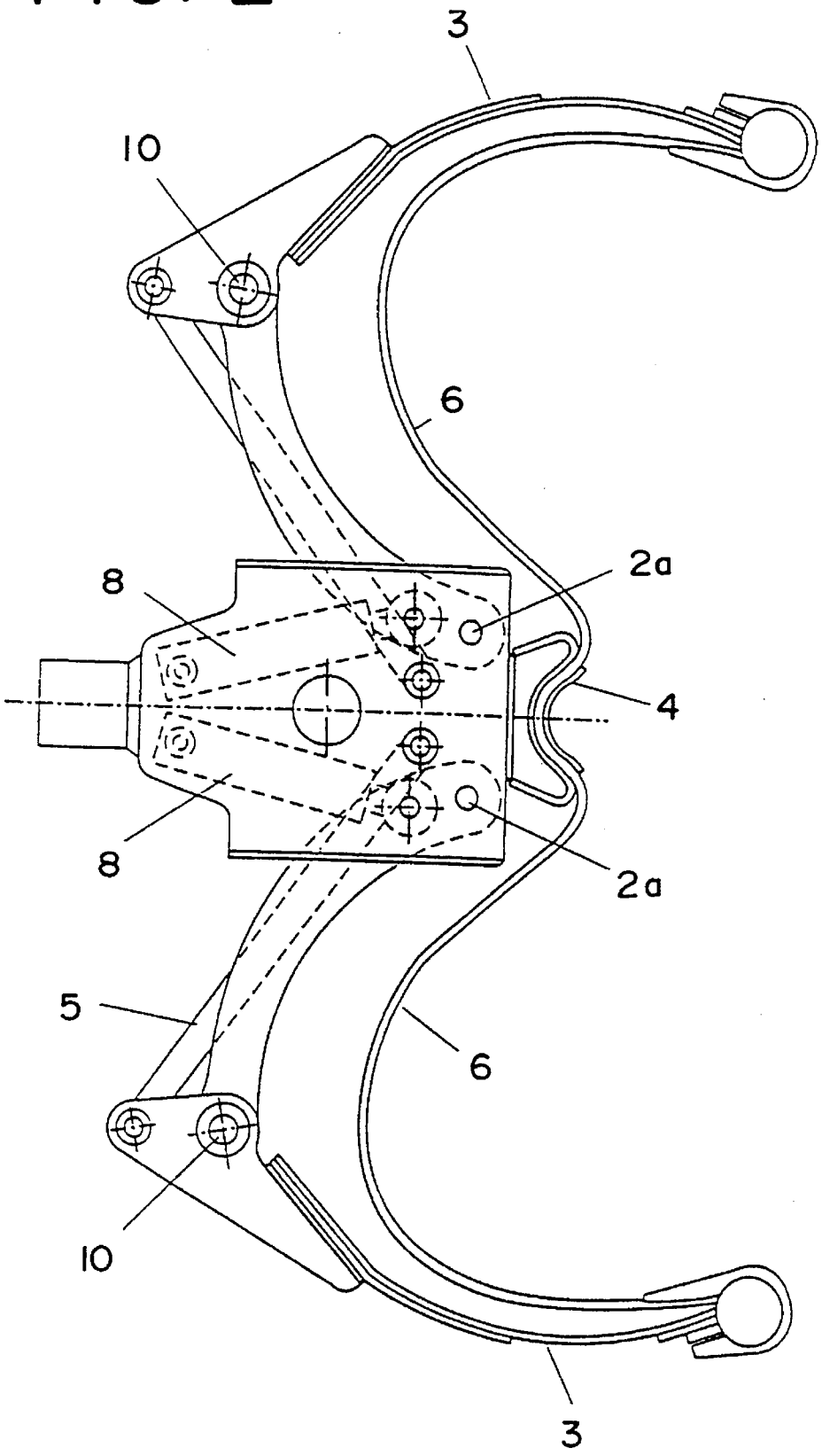
FIG. 2 is a plan view of the same grabber mechanism in a folded or retracted position.

Preferably the belt is a multi-backed belt with a fingerprint style rubber on the face contacting the bin. The belt is of a non-stretch design and is therefore drawn tight around a bin during operation of the power cylinders and flexible arms supporting the belt. With reference to FIG. 2, this shows the grabbing mechanism in a fully folded position with the arm members 2 and 3 fully retracted and barely protruding from the mounting structure 1.

Figure 3:
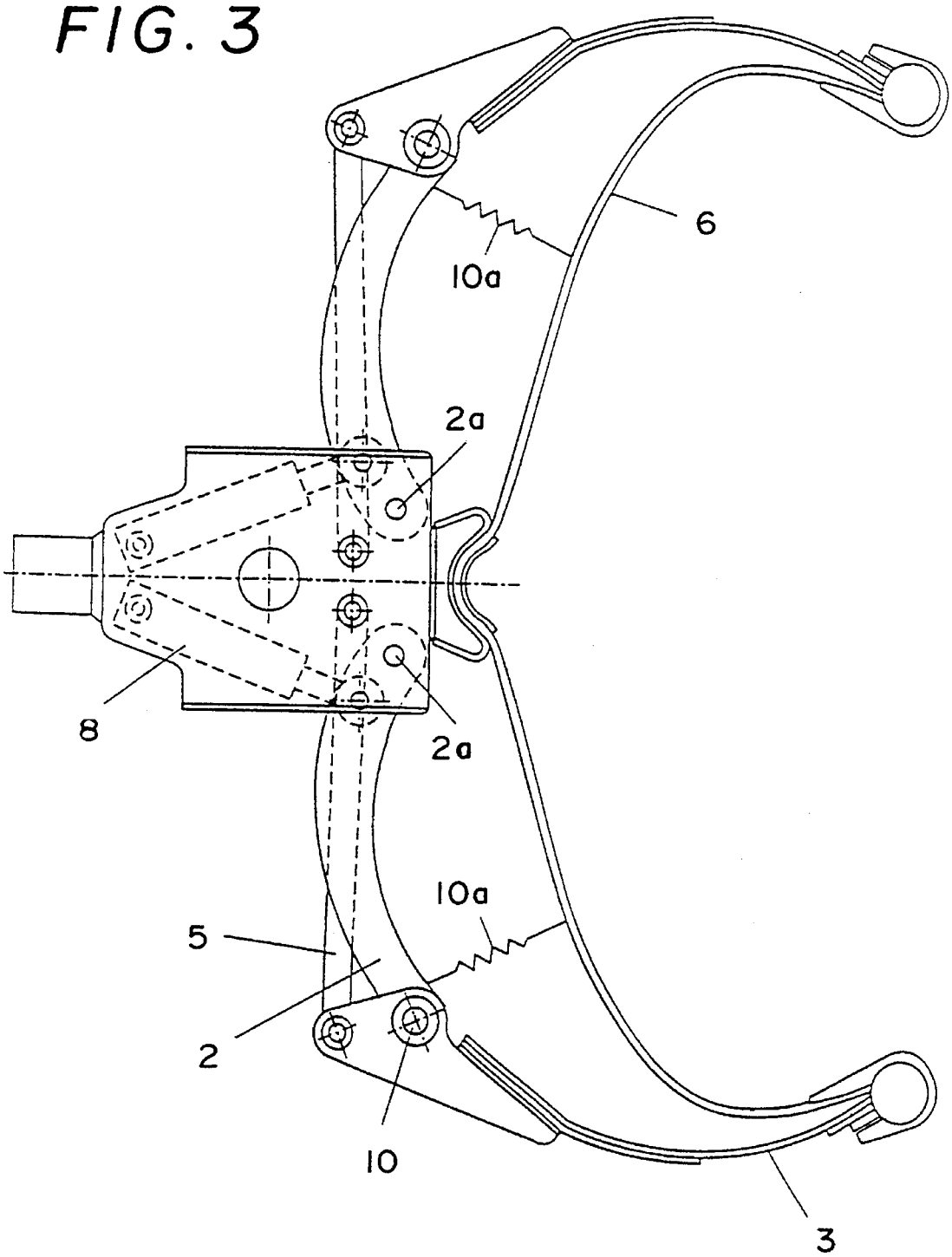
FIG. 3 is a plan view of the grabber mechanism moving towards a clamping position.

The arrangement shown in FIGS. 3 and 4 show the movement of the clamping arms from the fully retracted position to a clamping position in which the arms move outwardly in a more or less linear fashion from the support housing.

FIG. 5 shows in greater detail the support for the grabbing mechanism showing the manner of pivoting of the grabber mechanism from a street level position to the tipping position.

The tipping linkage may be in accordance with our earlier Australian application No. 60231/90 entitled "A Side Life Rubbish Bin Lifter", showing the lifting linkage in greater detail, particularly relative to the grabbing mechanism. A similar lifting mechanism may be used as is described in the above referenced Australian specification in connection with the current grabbing mechanism.

The major components of the lifting mechanism include a rotary actuator 11, 11A. In this regard one of the rotary actuators 11A may be dispensed with for light weight lifts of no more than 75 kg. These actuators 11, 11A are mounted on a base support plate 12 connected to a transverse slide 13, that is movable transversely of the truck for up to a distance of 1.8 meters. Thus, the grabbing mechanism may be moved in and out towards a bin to be engaged for a total distance of 1.8 meters.

The main grabber arrangement attaches to the drive member 14 which includes levelling struts 15 and 15A to control the lifting motion of the grabber mechanism in a specific pattern of arcuate movement.

The grab assembly is therefore controlled from moving through its at rest position to an angle of almost 150° when the tipping of the bin occurs at the top of its travel. During initial lifting movement from the park position through 90° the arm members 3 remain approximately parallel to the ground so that the bin remains almost vertical until movement through 150° whence the grab assembly commences a tipping arc from 150° to 180° of its travel. As previously mentioned this is described in greater detail in our earlier Australian application No. 60231/90.

Figure 6:
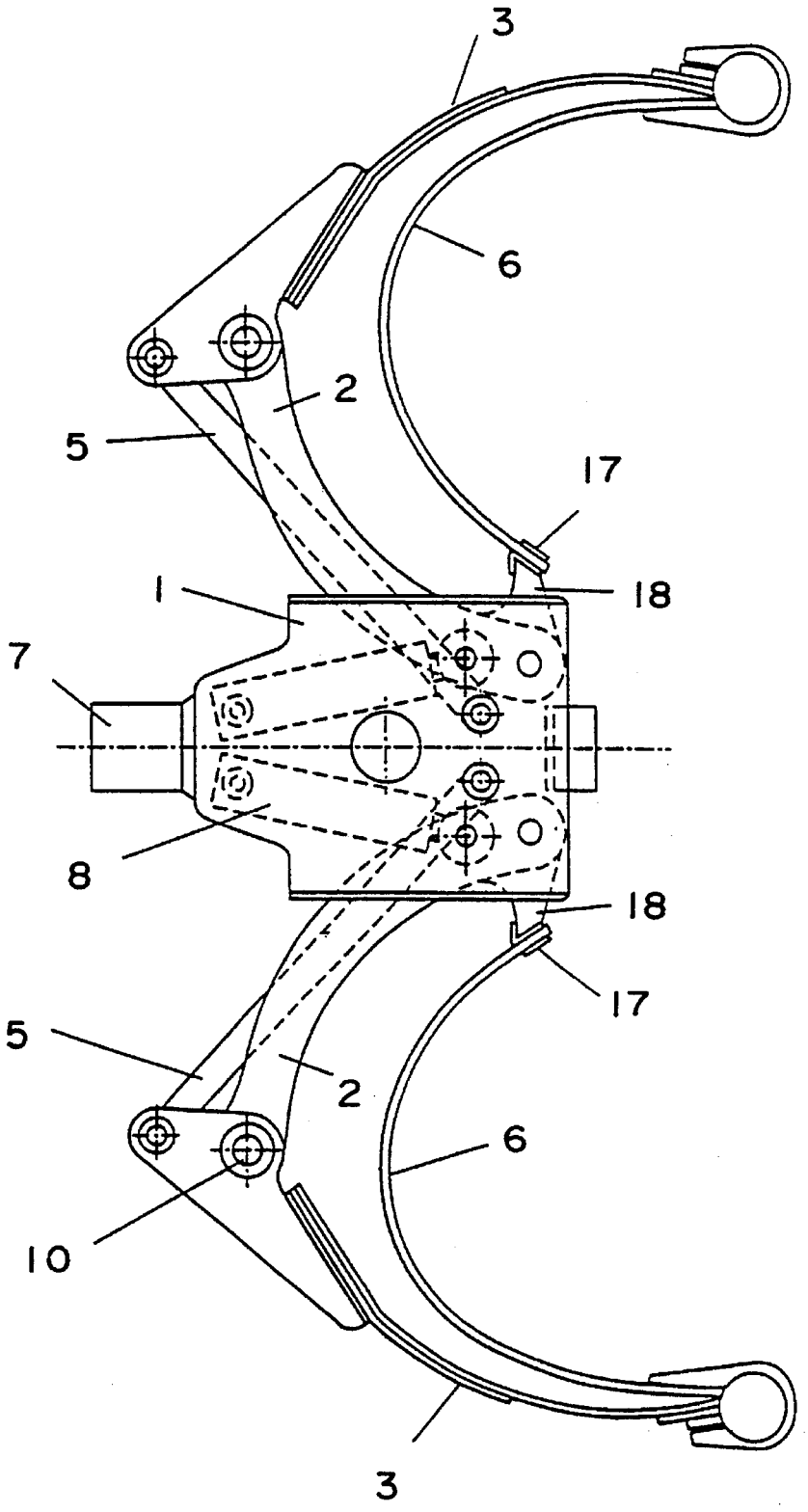
FIG. 6 is a plan view of the further embodiment of the grabber mechanism in folded or retracted position showing a modified belt attachment.

With reference to FIG. 6 the belt 6 is formed in two parts as shown and secured at each end. The inner ends 17 of the belt are secured to blocks 18 connected directly to the shoulder pivots 2*a*. This has the desirable effect of limiting the belt span between the connecting points and thereby reducing the likelihood of belt sag in its untensioned condition.

I claim:

1. A refuse bin grabbing apparatus for grabbing and moving a bin to an elevated unloading position, the apparatus comprising:

bin engaging means including a support means, clamping arms pivotally mounted on the support means, wherein the clamping arms are adapted to each be folded to lie on either side of the support means when in a rest position from which the clamping arms are adapted to be unfolded to project and receive the bin, guide means for controlling the unfolding movement of the clamping arms from the rest position to promote an outward projection of the clamping arms from the bin engaging means to receive the bin while limiting the span of the clamping arms lateral to the direction of projection, said guide means including a link extending between each clamping arm and the support means, each link being pivotally joined to both the support means and the respective clamping arm;

a power driven linkage for mounting on a vehicle, said power driven linkage connected to the bin engaging means and arranged to move the bin engaging means into engagement with the bin; and a power cylinder for each clamping arm arranged to move each clamping arm between said rest position and a position wherein said clamping arms embrace the bin, wherein the power cylinder extends between the support means and a respective clamping arm and pivotally joins both the support means and a respective clamping arm.

2. An apparatus according to claim 1, wherein said clamping arms include belt means arranged to engage the bin under the tension caused by said clamping arms moving the belt means into embracing engagement with the bin.

3. An apparatus according to claim 2, wherein the belt means comprise a belt having one end fastened near the forward end of each respective clamping arm and the other end fastened to one of the support means and the rear of the clamping arm.

4. An apparatus according to claim 1, wherein each clamping arm includes a shoulder member mounted for pivotal movement about the support means, and a forward arm member pivotally joined to each shoulder member.

5. An apparatus according to claim 4, wherein each link extends between the respective forward arm member and the support means.

6. A refuse bin grabbing apparatus for grabbing and moving a bin to an elevated unloading position, the apparatus comprising:

bin engaging means including a support means, a pair of clamping arms, each clamping arm having a shoulder pivotally mounted on the support means, each shoulder having a forward arm member pivotally joined thereto, a pair of power cylinders arranged to move each clamping arm between a rest position and a bin clamping position, said power cylinders pivotally joined to the support means and extending to pivotally join a respective shoulder, and a pair of links pivotally joined to the support means and extending to pivotally join the respective forward arm member, wherein the pair of clamping arms are adapted to be folded to a rest position at which the clamping arms lie generally in line with and on either side of the support means; and a power driven linkage for mounting on a vehicle, said power driven linkage connected to the bin engaging means and arranged to move the bin engaging means into engagement with the bin.

7. An apparatus according to claim 6, wherein the links are each joined to the respective forward arm members in a position which is laterally outside the position of the respective pivotal joint between the respective shoulder and forward arm member.

8. An apparatus according to claim 6, wherein each clamping arm includes a belt having one end fastened to the respective forward arm member and the other end fastened to at least one of the respective shoulder and the support means.

9. A refuse bin grabbing apparatus for grabbing and moving a bin to an elevated unloading position, the apparatus comprising:

bin engaging means including a support means, a pair of clamping arms, each clamping arm having a shoulder pivotally mounted on the support means, each shoulder having a forward arm member pivotally joined thereto, a pair of power cylinders arranged to move each clamping arm between a rest position and a bin clamping position, said power cylinders pivotally joined to the support means and extending to pivotally join a respective shoulder, and a pair of links pivotally joined to the support means and extending to pivotally join the respective forward arm member, wherein the pair of clamping arms are adapted to be folded to a rest position at which a pivotal joint between the respective forward arm member and shoulder lies to the rear of the pivotal mounting between the respective shoulder and the support means; and a power driven linkage for mounting on a vehicle, said power driven linkage connected to the bin engaging means and arranged to move the bin engaging means forward into engagement with the bin.

10. An apparatus according to claim 9, wherein the links are joined to the respective forward arm members in a position which is laterally outside the position of the respective pivotal joint between the respective forward arm member and shoulder.

11. An apparatus according to claim 9, wherein each clamping arm includes a belt having one end fastened to the respective forward arm member and the other end fastened to at least one of the respective shoulder and the support means.

12. A refuse bin grabbing apparatus for grabbing and moving a bin to an elevated unloading position, the apparatus comprising:

bin engaging means including a support means, a pair of clamping arms, foldable between a rest position and bin clamping position and pivotally mounted on the support means, a flexible belt for each clamping arm, a first end of each flexible belt being fastened to the respective clamping arm near a forward end of the clamping arm, a second end of each flexible belt being fastened to at least one of the respective clamping arm or the support means, wherein unfolding of the clamping arms from the rest position to the bin clamping position causes the belts to be tensioned to engage and clamp the bin;

a link extending between each clamping arm and the support means, each link being pivotally joined to both the support means and the respective clamping arm to control the lateral span of the clamping arms in unfolding from the rest position to the bin clamping position; and a power driven linkage for mounting on a vehicle, said power driven linkage connected to the bin engaging means and arranged to move the bin engaging means into engagement with the bin.

13. An apparatus according to claim 12, wherein the belts have front and rear ends which are fastened in positions where unfolding of each clamping arm causes an increase in separation of front and rear fastening positions.

14. An apparatus according to claim 13, wherein the clamping arms each include a shoulder having a forward arm member pivotally joined thereto, the forward fastening of the belt being located on the forward arm member and the rear fastening of the belt being located on at least one of the support means and shoulder.

15. An apparatus according to claim 12, wherein the clamping arms each include a shoulder having a forward arm member pivotally joined thereto, the forward fastening of the belt being located on the forward arm member and the rear fastening of the belt being located on the shoulder.

* * * * *